US008193999B2

(12) United States Patent
Takasaki

(10) Patent No.: US 8,193,999 B2
(45) Date of Patent: Jun. 5, 2012

(54) DISPLAY DEVICE

(75) Inventor: Naoyuki Takasaki, Chino (JP)

(73) Assignee: Sony Corporation, Tokyo (JP)

( * ) Notice: Subject to any disclaimer, the term of this patent is extended or adjusted under 35 U.S.C. 154(b) by 470 days.

(21) Appl. No.: 12/465,116

(22) Filed: May 13, 2009

(65) Prior Publication Data

US 2009/0303155 A1 Dec. 10, 2009

(30) Foreign Application Priority Data

Jun. 5, 2008 (JP) ..... 2008-147802
Jun. 5, 2008 (JP) ..... 2008-147803

(51) Int. Cl.
*G09G 5/00* (2006.01)

(52) U.S. Cl. ..... 345/1.1; 345/1.3; 345/208; 345/94; 345/214; 348/441

(58) Field of Classification Search ..... 345/1.1–3.4, 345/5, 6, 84–104, 204, 208, 214; 348/441, 348/552

See application file for complete search history.

(56) References Cited

U.S. PATENT DOCUMENTS 6,512,497 B1 * 1/2003 Kondo et al. ..... 345/1.1
6,762,809 B1 * 7/2004 Murade ..... 349/110
2001/0019320 A1 * 9/2001 Lee et al. ..... 345/87
2006/0001636 A1 * 1/2006 Okutani ..... 345/100
2007/0139297 A1 * 6/2007 Kudo et al. ..... 345/1.1

FOREIGN PATENT DOCUMENTS

JP A-7-295521 11/1995
JP A-2003-202847 7/2003
JP A-2006-154225 6/2006

* cited by examiner

*Primary Examiner* — Lun-Yi Lao
*Assistant Examiner* — Md Saiful A Siddiqui
(74) *Attorney, Agent, or Firm* — K&L Gates LLP

(57) ABSTRACT

A display device includes: a plurality of display panels which each have a plurality of pixels provided in correspondence with intersections of a plurality of scanning lines and a plurality of data lines and a driving circuit supplying image data to the data lines; and a control circuit which controls the driving circuits of the plurality of display panels, wherein panel characteristics of the plurality of display panels are different from each other and one of the plurality of display panels is set to a non-display state, wherein the control circuit includes a precharge circuit supplying a common precharge voltage to the data lines of each of the display panels, and wherein the precharge voltage is set so as to have a voltage value corresponding to the panel characteristic of the display panel set to the non-display state.

15 Claims, 10 Drawing Sheets

DISPLAY DEVICE

BACKGROUND

1. Technical Field

The present invention relates to a display device capable of driving a plurality of display panels having different panel characteristics one another.

2. Related Art

In the past, there was known an active matrix display device which supplies a predetermined precharge signal to signal lines immediately before an image signal is written to pixels arranged in one row (for example, see JP-A-H07-295521). This active matrix display device supplies a precharge signal having a middle level of the image signal which varies between a white level and a black level.

Moreover, as a display device performing polarity reversion driving in each of lines, there is known a display device in which a positive precharge signal in positive voltage driving and a negative precharge signal in negative voltage driving are asymmetric with respect to the center of the amplitude of an image data voltage (for example, see JP-2003-202847).

There is also known a display device such as a digital video camera or a digital still camera which includes two display panels and simultaneously drive the two display panels by use of one chip IC as a control circuit (for example, see JP-A-2006-154225). In such a display device, when the two display panels are mutually displayed, the display panel which does not perform a display just performs precharge driving to supply a precharge voltage to pixels.

However, the display panels have different panel characteristics such as a driving frequency and a driving voltage in accordance with a driving method, a panel size, or the like. When the display panels having the different panel characteristics are simultaneously driven by use of the one chip IC, appropriate precharge voltages are different from each other and a voltage (for example, a central voltage of the amplitude of the image data voltage in the display panel which performs the display) set in correspondence with the panel characteristics of the display panel which performs the display is set as the precharge voltage in the precharge driving in a general way.

In this case, however, in the display panel (which is the display panel just performing the precharge driving) which does not perform the display, a different pixel voltage is written to each frame. Therefore, since a DC voltage is normally applied, a problem with burn-in may occur.

The panel characteristics of the display panel are different depending on a method of driving a liquid crystal display panel. As the method of driving the liquid crystal display panel, there are known two methods, that is, a longitudinal electric field driving method of driving liquid crystal molecules by use of an electric field (a longitudinal electric field) generated between pixel electrodes of one glass substrate and a common electrode of the other glass substrate and a transverse electric field driving method of driving liquid crystal molecules by use of an electric field (a transverse electric field) generated in an in-plane direction with respect to a glass substrate. In general, it is known that the burn-in occurs more easily in the transverse electric field driving method than in the longitudinal electric field driving method. Accordingly, when the display panel which does not perform the display is a liquid crystal display panel employing the transverse electric field driving method, the burn-in is easily caused due to application of the DC voltage.

SUMMARY

An advantage of some aspects of the invention is that it provides a liquid crystal display device capable of preventing burn-in during precharge driving, even when a plurality of display panels having different panel characteristics are simultaneously driven.

According to an aspect of the invention, there is provided a display device including: a plurality of display panels which each have a plurality of pixels provided in correspondence with intersections of a plurality of scanning lines and a plurality of data lines and a driving circuit supplying image data to the data lines; and a control circuit which controls the driving circuits of the plurality of display panels. Panel characteristics of the plurality of display panels are different from each other and one of the plurality of display panels is set to a non-display state. The control circuit includes a precharge circuit supplying a common precharge voltage to the data lines of each of the display panels. The precharge voltage is set so as to have a voltage value corresponding to the panel characteristic of the display panel set to the non-display state.

With such a configuration, since the precharge voltage is supplied to the data lines, pixel writing can be sufficiently performed even in a case where a writing polarity is different in each frame. Accordingly, it is possible to improve a display quality of the display panel set to the display state.

A voltage corresponding to the panel characteristics of the display panel set to the non-display state is supplied as the precharge voltage. Therefore, even when the writing polarity is reversed in each frame, a voltage different in each frame is prevented from being written to the pixels of the display panel set to the non-display state. As a result, since the DC voltage is not allowed to be normally applied, the burn-in can be prevented from occurring in the display panel set to the non-display state.

Accordingly, even when the panel characteristics of the plurality of display panels are different from each other, the display panels can be simultaneously driven (mutually displayed) without a problem.

In the display device according to this aspect of the invention, the precharge voltage may be set to a central voltage of the amplitude of an image data voltage in the display panel set to the non-display state.

With such a configuration, since the precharge voltage can be set to an appropriate value corresponding to the panel characteristics, the burn-in in the display panel set to the non-display state can be more effectively prevented.

In the display device according to this aspect of the invention, the precharge circuit may include switches which are each connected to a precharge line feeding the precharge voltage and the data lines and which electrically connect the precharge line to the data lines at predetermined timing. The data lines may be controlled by use of the precharge voltage by controlling the switches to electrically connect the precharge line to the data lines. With such a configuration, the precharge circuit can be realized with a relatively simple circuit configuration.

In the display device according to this aspect of the invention, the precharge circuit may supply the common precharge voltage to the data lines of each of the display panels during an invalid display period of one horizontal scanning period.

With such a configuration, since the precharge voltage is supplied before the image signal is supplied to the data lines (during the invalid display period), the pixel writing can be sufficiently performed even in the case where the writing polarity is different in each frame. Accordingly, it is possible to improve the display quality of the display panel set to the display state.

In the display device according to this aspect of the invention, the display panel set to the non-display state among the plurality of display panels may stop the driving circuit and write the precharge voltage maintained in the data lines to the pixels.

With such a configuration, since the power consumption can be suppressed, the precharge voltage maintained in the data lines can be easily written to the pixels of the display panels set to the non-display state.

In the display device according to this aspect of the invention, the pixels of the display panel set to the non-display state among the plurality of display panels may maintain the precharge voltage during about one vertical scanning period.

With such a configuration, since the voltage to be applied to liquid crystal can be made appropriate in the non-display state, the burn-in in the display panel set to the non-display state can be prevented.

In the display device according to this aspect of the invention, the display panel set to the non-display state among the plurality of display panels may stop the driving circuit and the precharge circuit may supply the precharge voltage to the data lines of the display panel set to the non-display state among the plurality of display panels during about one horizontal scanning period.

With such a configuration, since the precharge voltage can be written to the pixels through the data lines without deterioration, the burn-in in the display panel set to the non-display state can be more effectively prevented.

In the display device according to this aspect of the invention, the display panel set to the non-display state among the plurality of display panels may write the precharge voltage to the pixels at time in which the display panel set to the display state operates.

With such a configuration, since the voltage to be applied to the liquid crystal can be made appropriate in the non-display state, the burn-in in the display panel set to the non-display state can be prevented.

According to another aspect of the invention, there is provided a liquid crystal display device including: a plurality of display panels which each have a plurality of pixels provided in correspondence with intersections of a plurality of scanning lines and a plurality of data lines and a driving circuit supplying image data to the data lines; and a control circuit which controls the driving circuits of the plurality of display panels. The plurality of pixels are formed by a pair of substrates, which are opposed to each other with a liquid crystal layer interposed therebetween, and a common electrode and pixel electrodes which drive liquid crystal molecules of the liquid crystal layer. One of the plurality of display panels employs a transverse electric field driving method of driving the liquid crystal molecules by a transverse electric field. The control circuit includes a precharge circuit supplying a precharge voltage to the data lines of each of the display panels. The precharge voltage is set to a voltage value corresponding to the display panel employing the transverse electric field driving method.

With such a configuration, since the precharge voltage is supplied to the data lines, pixel writing can be sufficiently performed even in a case where a writing polarity is different in each frame. Accordingly, it is possible to improve a display quality of the display panel set to the display state.

A voltage corresponding to the panel characteristics of the display panel employing the transverse electric field driving method is supplied as the precharge voltage. Therefore, even when the writing polarity is reversed in each frame, a voltage different in each frame is prevented from being written to the pixels of the display panel employing the transverse electric field driving method. As a result, since the DC voltage is not allowed to be normally applied, the burn-in can be prevented from occurring in the display panel employing the transverse electric field driving method.

Accordingly, even when the methods of driving the plurality of display panels are different from each other, the display panels can be simultaneously driven (mutually displayed) without a problem by setting the precharge voltage corresponding to the display panel in which the burn-in easily occurs.

In the liquid crystal display panel according to this aspect of the invention, the precharge voltage is set to a central voltage of the amplitude of an image data voltage in the display panel employing the transverse electric field driving method.

With such a configuration, since the precharge voltage can be set to an appropriate value corresponding to the panel characteristics, the burn-in in the display panel employing the transverse electric field driving method can be more effectively prevented.

In the liquid crystal display panel according to this aspect of the invention, the precharge circuit may include switches which are each connected to a precharge line feeding the precharge voltage and the data lines and which electrically connect the precharge line to the data lines at predetermined timing. The data lines may be controlled by use of the precharge voltage by controlling the switches to electrically connect the precharge line to the data lines.

With such a configuration, the precharge circuit can be realized with a relatively simple circuit configuration.

In the liquid crystal display panel according to this aspect of the invention, the precharge circuit may supply the common precharge voltage to the data lines of each of the display panels during an invalid display period of one horizontal scanning period.

With such a configuration, since the precharge voltage is supplied before the image signal is supplied to the data lines (during the invalid display period), the pixel writing can be sufficiently performed even in the case where the writing polarity is different in each frame. Accordingly, it is possible to improve the display quality of the display panel set to the display state.

In the liquid crystal display panel according to this aspect of the invention, the display panel set to the non-display state among the plurality of display panels may stop the driving circuit and write the precharge voltage maintained in the data lines to the pixels.

With such a configuration, since the power consumption can be suppressed, the precharge voltage maintained in the data lines can be easily written to the pixels of the display panels set to the non-display state.

In the liquid crystal display panel according to this aspect of the invention, the pixels of the display panel set to the non-display state among the plurality of display panels may maintain the precharge voltage during about one vertical scanning period.

With such a configuration, since the voltage to be applied to liquid crystal can be made appropriate in the non-display state, the burn-in in the display panel set to the non-display state can be more effectively prevented.

In the liquid crystal display panel according to this aspect of the invention, the display panel set to the non-display state among the plurality of display panels may stop the driving circuit and the precharge circuit may supply the precharge voltage to the data lines of the display panel set to the non-display state among the plurality of display panels during about one horizontal scanning period.

With such a configuration, since the precharge voltage can be supplied to the pixels so that the voltage to be applied to the liquid crystal is made appropriate in the non-display state, the burn-in in the display panel set to the non-display state can be prevented.

In the liquid crystal display panel according to this aspect of the invention, the display panel set to the non-display state among the plurality of display panels may write the precharge voltage to the pixels at time in which the display panel set to the display state operates.

With such a configuration, since the precharge voltage can be written to the pixels through the data lines without deterioration, the burn-in in the display panel set to the non-display state can be more effectively prevented.

In the liquid crystal display device according to this aspect of the invention, the plurality of display panels may each include a backlight unit and the backlight unit of the display panel set to the non-display state may be turned off.

With such a configuration, since the display panel to be set to the non-display state can be surely set to the non-display state, the burn-in in the display panel can be prevented while suppressing the power consumption.

BRIEF DESCRIPTION OF THE DRAWINGS

The invention will be described with reference to the accompanying drawings, wherein like numbers reference like elements.

FIG. 5 is a flowchart illustrating a driving sequence at the time of power ON.

DESCRIPTION OF EXEMPLARY EMBODIMENTS

Figure 1:
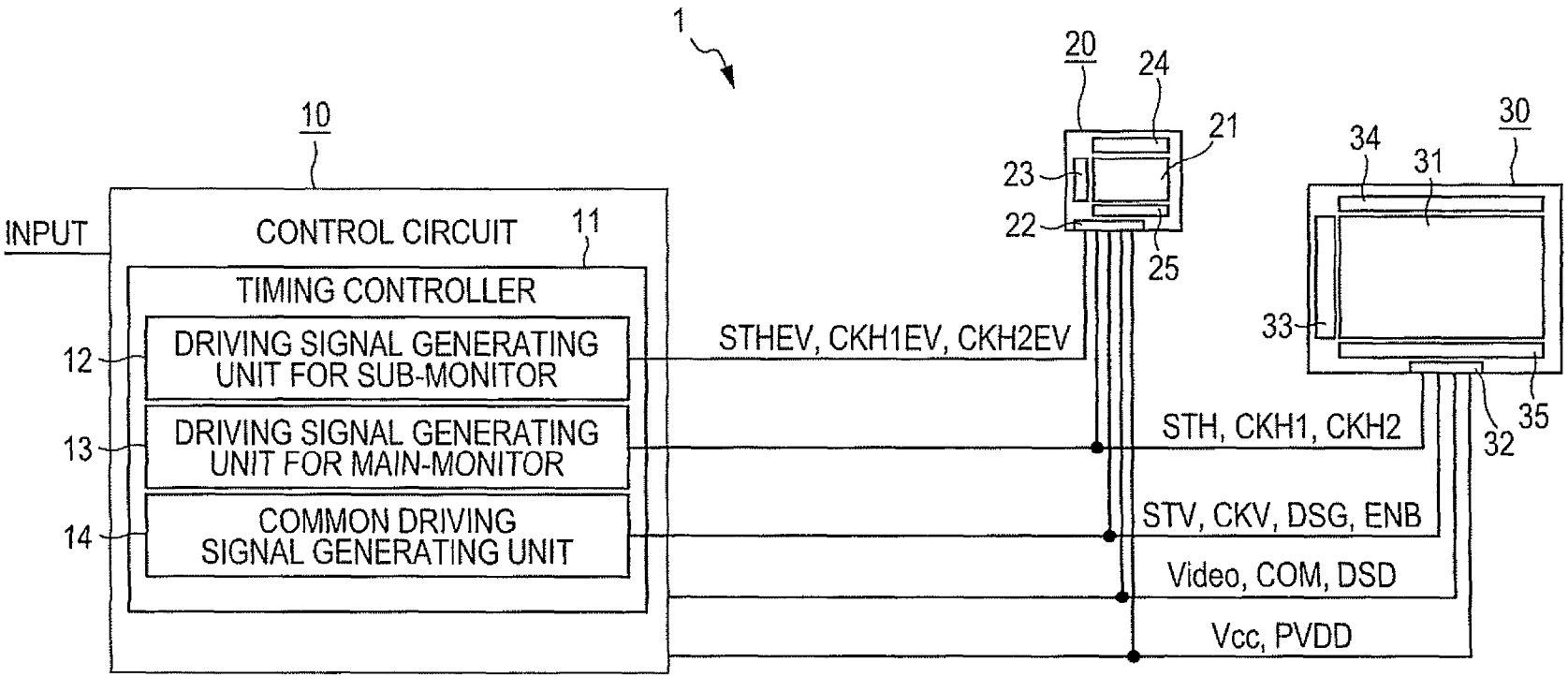
FIG. 1 is a block diagram illustrating the configuration of a display device according to embodiments.

Hereinafter, a first embodiment of the invention will be described with reference to the drawings. FIG. 1 is a block diagram illustrating the configuration of a display device 1 according to the first embodiment. In the first embodiment of the invention, a liquid crystal display device which includes two liquid crystal display panels for an LCD monitor and a liquid crystal electronic viewfinder (EVF) and is applied to a digital video camera or a digital still camera, for example, will be described. Here, a liquid crystal display panel using an active matrix mode thin film transistor (TFT) is used for the LCD monitor or the electronic viewfinder (EVF).

As shown in FIG. 1, the display device 1 includes an EVF liquid crystal display panel (sub-monitor) 20, an LCD monitor liquid crystal display panel (main monitor) 30, and a control circuit 10 controlling drive of the two display panels 20 and 30. In the display device 1 according to the first embodiment, one control circuit 10 is configured to drive the two display panels 20 and 30.

In the control circuit 10, one chip IC is provided and a timing controller 11 is formed therein. The timing controller 11 generates various driving signals to be supplied to the display panels 20 and 30.

The timing controller 11 includes: a driving signal generating unit 12 for the sub-monitor which generates, as driving signals for the sub-monitor 20, a horizontal start signal STHEV for the sub-monitor 20 and horizontal clock signals CKH1EV and CKH2EV for the sub-monitor 20; a driving signal generating unit 13 for the main monitor which generates, as driving signals for the main monitor 30, a horizontal start signal STH for the main monitor 30 and horizontal clock signals CKH1 and CKH2 for the main monitor 30; and a common driving signal generating unit 14 which generates, as common driving signals for the sub-monitor 20 and the main monitor 30, a vertical start signal STV, a vertical clock signal CKV, and an enable signal ENB, and a precharge signal DSG.

In this way, the timing controller 11 generates the horizontal start signals and the horizontal clock signals in correspondence with the number of the display panels. Moreover, the timing controller 11 is configured to perform display switch between the two display panels by controlling operation states of the horizontal start signals and the horizontal clock signals in each of the display panels.

Here, the driving of each liquid crystal panel is controlled by a dot-sequence driving method. In addition, the horizontal clock signals CKH1EV and CKH2EV have a reverse phase relation one another. The horizontal clock signals CKH1 and CKH2 also have a reverse phase relation one another.

The two display panels 20 and 30 have the same basic configuration. That is, the display panels 20 and 30 includes image display units 21 and 31, input terminals 22 and 32, vertical scanning circuits 23 and 33, horizontal scanning circuit 24 and 34, and precharge circuits 25 and 35, respectively.

Figure 2:
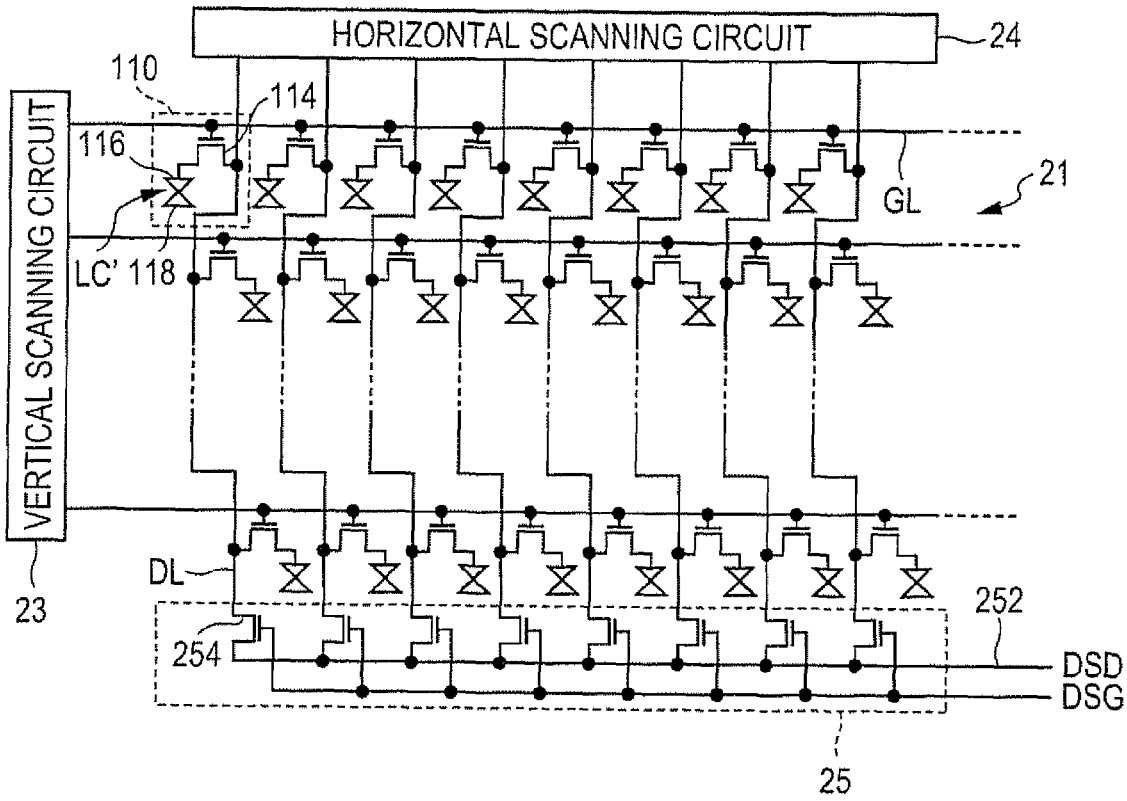
FIG. 2 is a circuit diagram illustrating the configuration of a sub-monitor.
Figure 3:
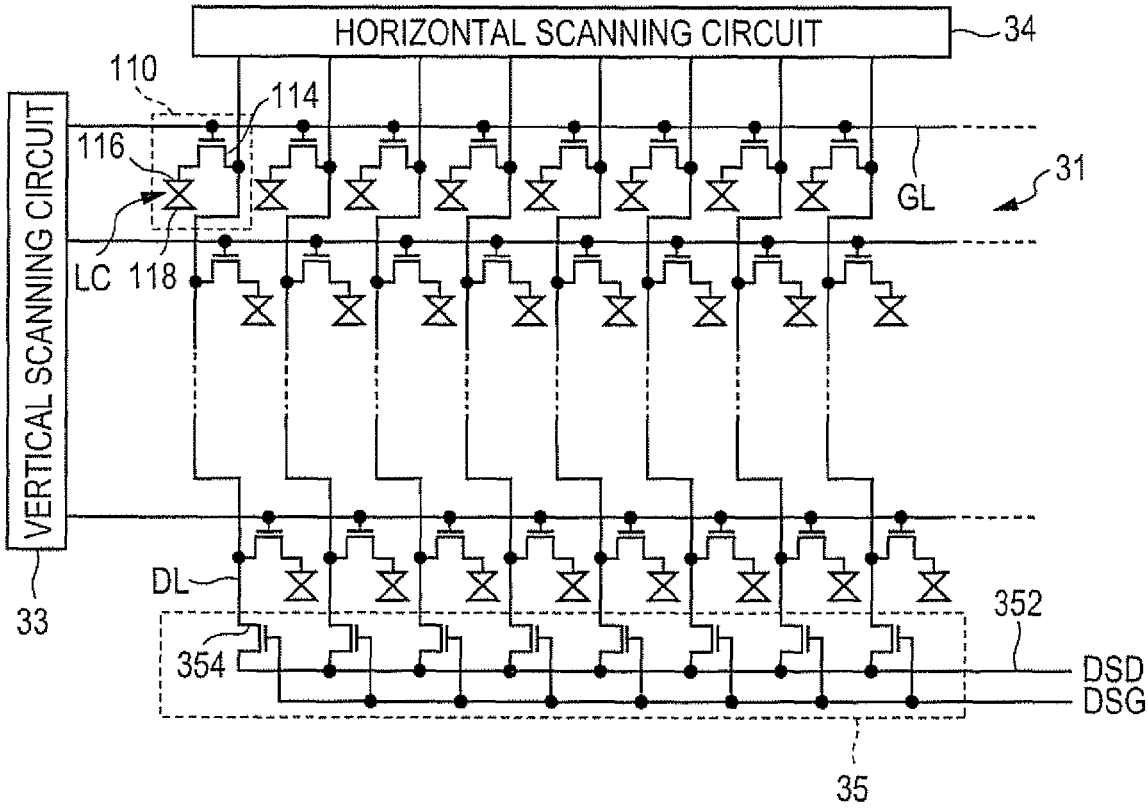
FIG. 3 is a circuit diagram illustrating the configuration of a main monitor.

FIG. 2 is a circuit diagram illustrating the configuration of the sub-monitor 20. FIG. 3 is a circuit diagram illustrating the configuration of the main monitor 30.

In each of the image display units 21 and 31 of the display panels 20 and 30, a plurality of gate lines (scanning lines) GL are arranged in parallel in a horizontal direction and a plurality of drain lines (data lines) DL are arranged in parallel in a vertical direction. In each of the image display units 21 and 31, individual pixels 110 are arranged in correspondence with individual intersections of the gate lines and the drain lines.

Each of the pixels 110 includes an n-channel type thin film transistor (hereinafter, referred to as a TFT) 114 serving as a pixel switch element and a pixel capacitor. A pixel capacitor included in each of the pixels 110 of the sub-monitor 20 is referred to as an LC' and a pixel capacitor included in each of the pixels 110 of the main monitor 30 is referred to as an LC.

Since the pixels 110 have the same configuration, the pixel 110 in a first row and a first column of the sub-monitor 20 will be described as a representative example. In the pixel 110 in the first row and first column, a gate electrode of a TFT 114 is connected to a first gate line GL, a source electrode of the TFT 114 is connected to a first drain line DL, and a drain electrode of the TFT 114 is connected to a pixel electrode 116 which is one end of the pixel capacitor LC'.

The other end of the pixel capacitor LC' is connected to a common electrode 118. The common electrode 118 is common to all the pixels 110 and a common voltage CON is supplied from the control circuit 10. Here, the common voltage CON is configured so that the polarity thereof is reversed periodically in accordance with writing polarity.

The common driving signals (STV, CKV, DSG, and ENB), power (Vcc and PVDD), image signals (Video, CON, and DSD), and the like output from the control circuit 10 are commonly input to the input terminals 22 and 32 of the display panels 20 and 30.

Moreover, the horizontal start signal STHEV and the horizontal clock signals CKH1EV and CKH2EV are additionally input to the input terminal 22 of the sub-monitor 20. In addition, the horizontal start signal STH and the horizontal clock signals CKH1 and CKH2 are additionally input to the input terminal 32 of the main monitor 30.

The vertical scanning circuits 23 and 33 of the display panels 20 and 30 include a vertical shift resistor and a plurality of switching circuits individually provided in the gate lines of the image display units 21 and 31, respectively. The switching circuit of each of the gate lines is driven in accordance with a driving signal from the vertical shift resistor and the driving voltage is applied to the corresponding gate line. The vertical start signal STV and the vertical clock signal CKV are input to vertical scanning circuit 23 and 33 of the two panels 20 and 30 are through the input terminals 22 and 32, respectively.

The horizontal scanning circuits 24 and 34 of the display panels 20 and 30 include a horizontal shift resistor and a plurality of sample-hold circuits individually provided in the drain lines of the image display units 21 and 31, respectively. The horizontal scanning circuits 24 and 34 are configured to have a function of a sampling circuit sampling image data to be displayed in each pixel from an input image signal.

The video output (Video and COM) the horizontal start signal STHEV, and the horizontal clock signals CKH1EV and CKH2EV are input to the horizontal scanning circuit 24 through the input terminal 22.

The video output (Video and COM), the horizontal start signal STH, and the horizontal clock signals CKH1 and CKH2 are input to the horizontal scanning circuit 34 through the input terminal 32.

The precharge circuit 25 of the sub-monitor 20 includes precharge switches 254 each electrically connecting each of the drain lines DL to a precharge line 252. The precharge circuit 25 supplies a predetermined precharge voltage DSD to the drain lines DL by simultaneously turning on the precharge switches 254 at predetermined timing for a predetermined period.

The precharge circuit 35 of the main monitor 30 includes precharge switches 354 each electrically connecting each of the drain lines DL to a precharge line 352. The precharge circuit 35 supplies a predetermined precharge voltage DSD to the drain lines DL by simultaneously turning on the precharge switches 354 at predetermined timing for a predetermined period.

A precharge signal DSG and the precharge voltage DSD are commonly input to the precharge circuits 25 and 35 through the input terminals 22 and 32, respectively.

Here, the precharge signal DSG is configured to be turned on within a horizontal blanking period (an invalid display period) during each horizontal scanning period. The precharge switches 254 and 354 are turned on in synchronization with the time of turning on the precharge signal DSG to electrically connect the drain lines DL to the precharge lines 252 and 352 and supply the precharge voltage DSD to the drain lines DL, respectively.

The two display panels 20 and 30 are configured so that when one thereof is set to a display state, the other thereof is set to a non-display state.

In this first embodiment, a voltage corresponding to characteristics of the display panel set to the non-display state is set as the precharge voltage DSD. Specifically, when the sub-monitor 20 is in the non-display state, a voltage $V_{DSDs}$ corresponding to panel characteristics of the sub-monitor 20 is set as the precharge voltage DSD. When the main monitor 30 is in the non-display state, a voltage $V_{DSDm}$ corresponding to panel characteristics of the main monitor 30 is set as the precharge voltage DSD.

Figure 4A:
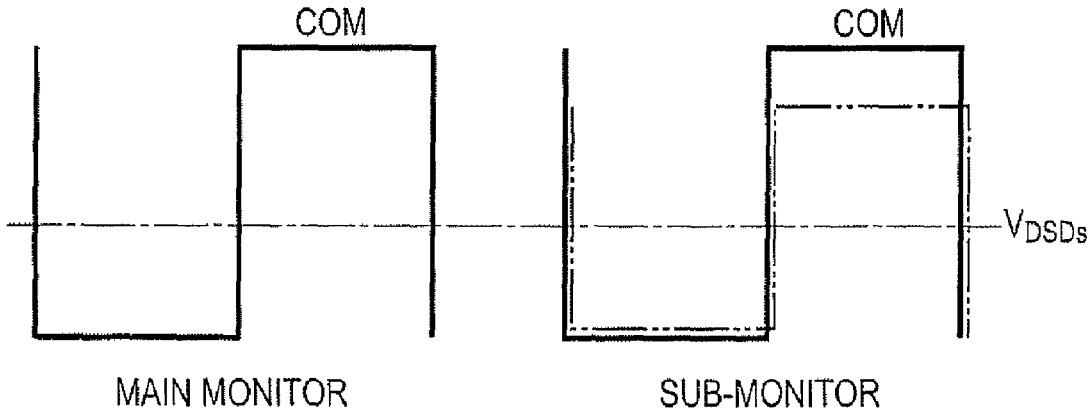
FIGS. 4A and 4B are diagrams illustrating a precharge voltage of each display state according to a first embodiment.
Figure 4B:
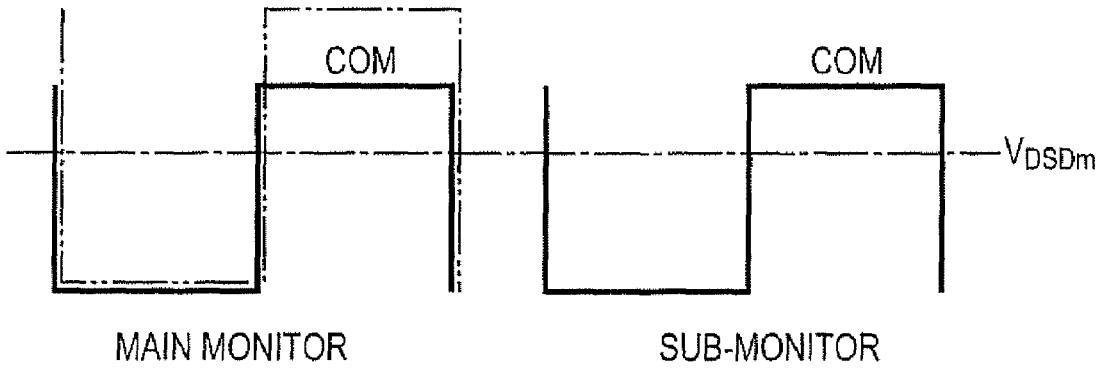

FIGS. 4A and 43 are diagrams each illustrating the precharge voltage DSD in each display state. FIG. 4A shows the precharge voltage DSD when the main monitor 30 is in the display state and FIG. 4B shows the precharge voltage DSD when the sub-monitor 20 is in the display state.

When the main monitor 30 is in the display state, as shown in FIG. 4A, a central voltage $V_{DSDs}$ of the amplitude of a video voltage (two-dot chain line) in the sub-monitor 20 is set as the precharge voltage DSD. When the sub-monitor 20 is in the display state, as shown in FIG. 4B, a central voltage $V_{DSDm}$ Of the amplitude of a video voltage (two-dot chain line) in the main monitor 30 is set as the precharge voltage DSD.

The control circuit 10 applies, as an initialization sequence, an OFF voltage to all the pixels of each display panel during a plurality of frame periods (for example, two frame periods), when the power of each display panel is turned ON/OFF or when display switch from the sub-monitor 20 to the main monitor 30 or display switch from the main monitor 30 to the sub-monitor 20 is performed. The OFF voltage means a state where a voltage is not applied to liquid crystal in case of a liquid crystal display panel. For example, a voltage of 0 V is applied to the pixels.

At this time, it is preferable that the timing controller 11 generates a horizontal clock signal reversed at the time of dividing an input frequency so that a margin occurs at the writing time to the pixels.

Figure 5:
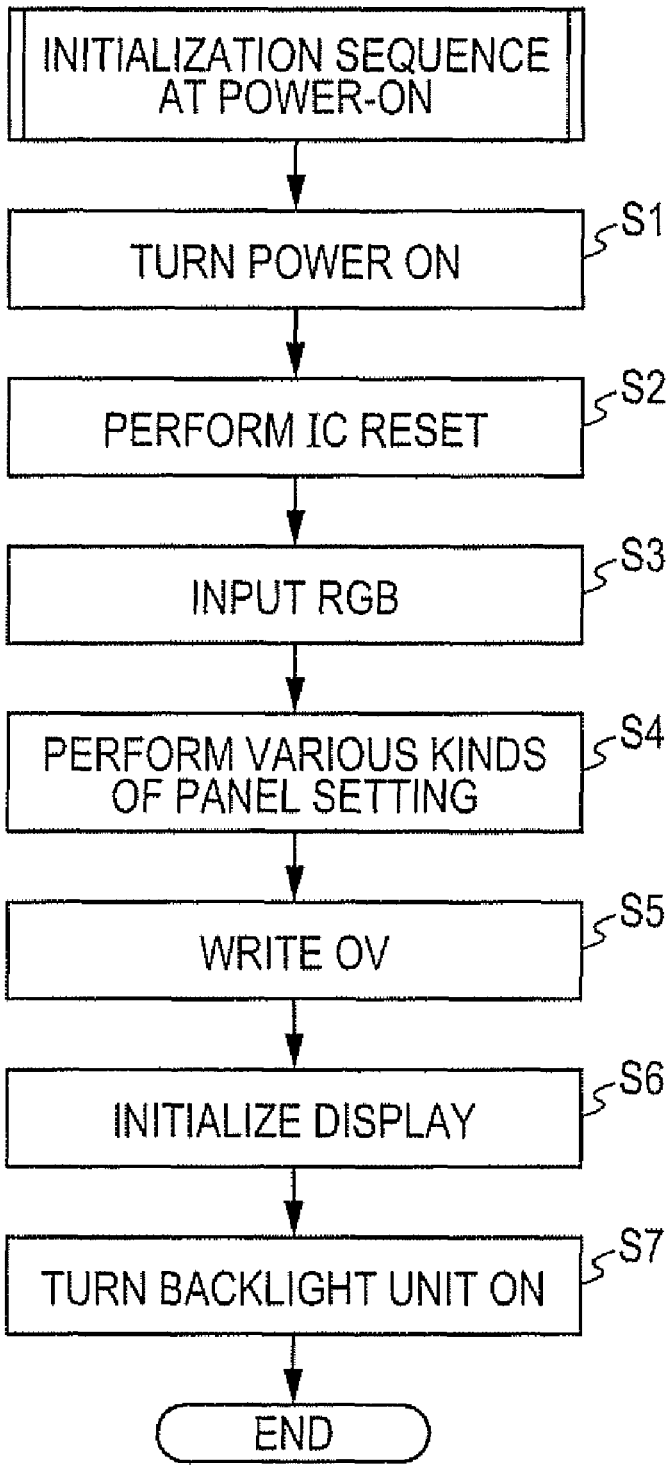

FIG. 5 is a flowchart illustrating a driving sequence at the time of power ON.

First, in Step S1 of FIG. 5, the video writing power Vcc and the panel driving power PVDD start to turn on the panel power. Then, the process proceeds to Step S2.

In Step S2, IC reset is performed to allow each panel to be set to a sleep mode. Specifically, the video output (Video, COM, and DSD), the common driving signals (STV, CKV, DSG and ENB), and the respective driving signals (STH, CKH1, CKH2, STHEV, CKH1EV, and CKH2EV) for the display panel are all set to a standby state.

In Step S3, an image signal of the input frequency according to the display panel set to the display state is input, and then the process proceeds to Step S4.

In Step S4, mode setting (gamma setting, normally white/normally black setting, or the like) of the display panel set to the display state is performed.

In Step S4, the precharge voltage DSD is set as the voltage according to the display panel set to the non-display state. That is, when the sub-monitor 20 is set to the non-display state, the precharge voltage DSD is set to the voltage $V_{DSDs}$. When the main-monitor 30 is set to the non-display sate, the precharge voltage DSD is set to the voltage $V_{DSDm}$. The output switch of the precharge voltage DSD can be realized by changing setting of the resister inside the control circuit 10. In this way, a state where a normal display of each display panel can start is established.

Subsequently, in Step S5, the initialization sequence is performed. At this time, the standby state of the common driving signals (STV, CKV, DSG, and ENB) and the respective panel driving signals (STH, CKH1, CKH2, STHEV, CKH1EV, and CKH2EV) is cancelled. Here, as the initialization sequence, the voltage of 0 V is input to all the pixels of the two display panels during two frame periods.

In Step S6, one of the two display panels is set to the display state and the other of the two display panels is set to the non-display state. Specifically, the horizontal start signal and the horizontal clock signals of the display panel set to the non-display state are stopped and the standby state of the video output (Video, COM, and DSD) is cancelled.

In Step S7, a normal display starts by turning on a backlight unit of the display panel set to the display sate.

Subsequently, the driving sequence at the time of switching the panel display will be described.

Figure 6:
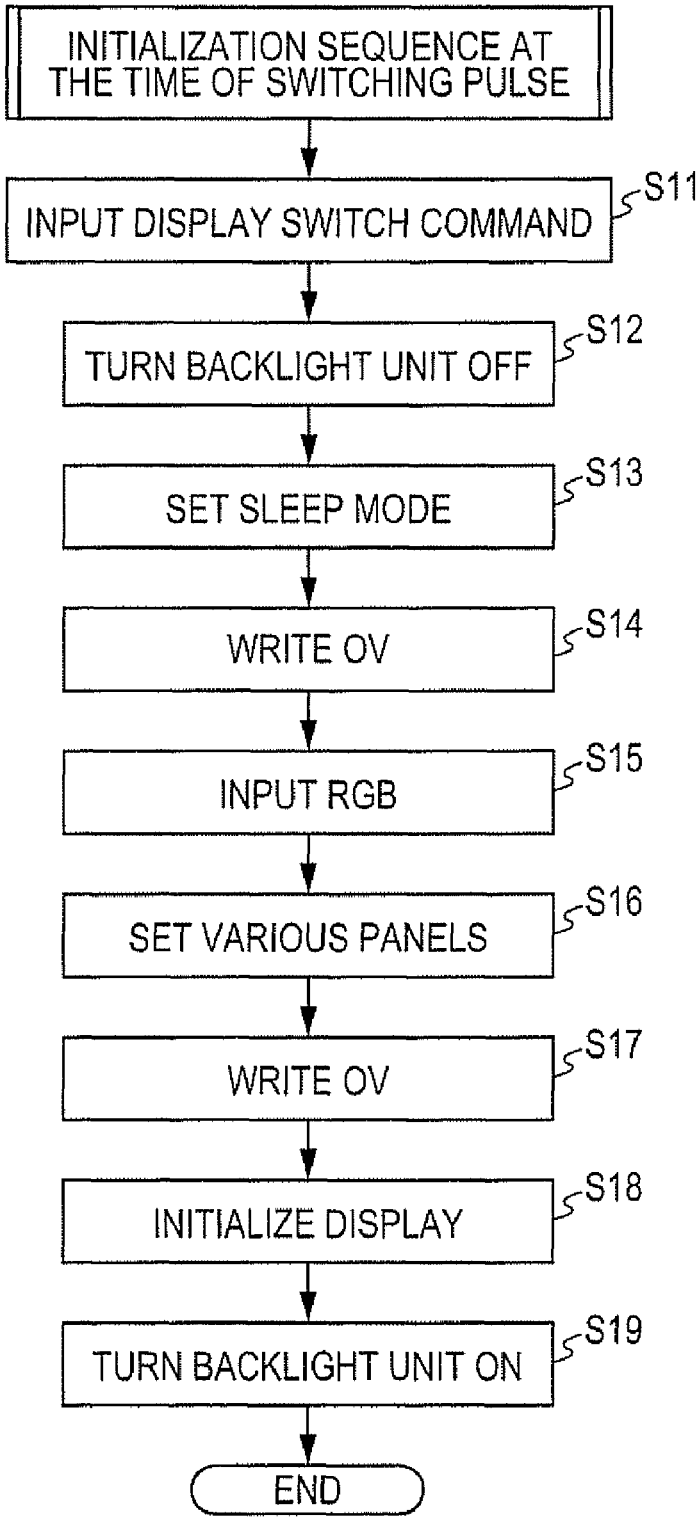
FIG. 6 is a flowchart illustrating a driving sequence at the time of switching a panel display.

FIG. 6 is a flowchart illustrating the driving sequence at the time of switching the panel display.

First, in Step S11 of FIG. 6, a display switch command is input to start the driving sequence for performing display switch from the sub-monitor 20 to the main monitor 30 or display switch from the main monitor 30 to the sub monitor 20.

In Step S12, the backlight unit of the display panel set to the display state is turned off, and then the process proceeds to Step S13.

In Step S13, the IC reset is performed to allow each panel to be set to a sleep mode. Specifically, the video output (Video, CON, and DSD), the common driving signals (STV, CKV, DSG, and ENB), and the respective driving signals (STH, CKH1, CKH2, STHEV, CKH1EV, and CKH2EV) are all set to a standby state. Accordingly, the image output of the two display panels is stopped.

Subsequently, in Step S14, as the initialization sequence, the voltage of 0 V is input to all the pixels of the two display panels during two frame periods.

In the initialization sequence, the standby state of the video output (Video, COM, and DSD) is maintained, and the standby state of the common driving signals (STV, CKV, DSG, and ENB) and the respective panel driving signals (STH, CK1, CKH2, STHEV, CKH1EV, and CKH2EV) is cancelled.

After the two frame periods, the common driving signals (STV, CKV, DSG, and ENB) and the respective panel driving signals (STH, CKH1, CKH2, STHEV, CKH1EV, and CKH2EV) is again set to the standby state to allow the two display panel to be in the sleep mode. Accordingly, the two display panels become a complete non-display state.

In Step S15, an image signal of an input frequency according to the display panel to be subsequently set to the display state is input.

In Step S16, the mode setting (gamma setting, normally white/normally black setting, or the like) of the display panel set to the display state is performed.

In Step S16, the precharge voltage DSD is set as the voltage according to the display panel set to the non-display state. That is, when the sub-monitor 20 is set to the non-display state, the precharge voltage DSD is set to the voltage $V_{DSDs}$. When the main monitor 30 is set to the non-display state, the precharge voltage DSD is set to the voltage $V_{DSDm}$. Accordingly, the state where the normal display of each display panel can start is established.

Subsequently, in Step S17, the initialization sequence is performed. Here, the voltage of 0 V is input to all the pixels of the two display panels during two frame periods. At this time, the standby state of the common driving signals (STV, CKV, DS, and ENB) and the respective panel driving signals (STH, CKH1, CKH2, STHEV, CKH1EV, and CKH2EV) is cancelled.

In Step S18, one of the two display panels is set to the display state and the other thereof is set to the non-display state. Specifically, the horizontal start signal and the horizontal clock signals of the display panel set to the non-display state are stopped and the standby state of the video output (Video, COM, and DSD) is cancelled.

In Step S19, the normal display starts by turning on the backlight unit of the display panel set to the display state.

Figure 7:
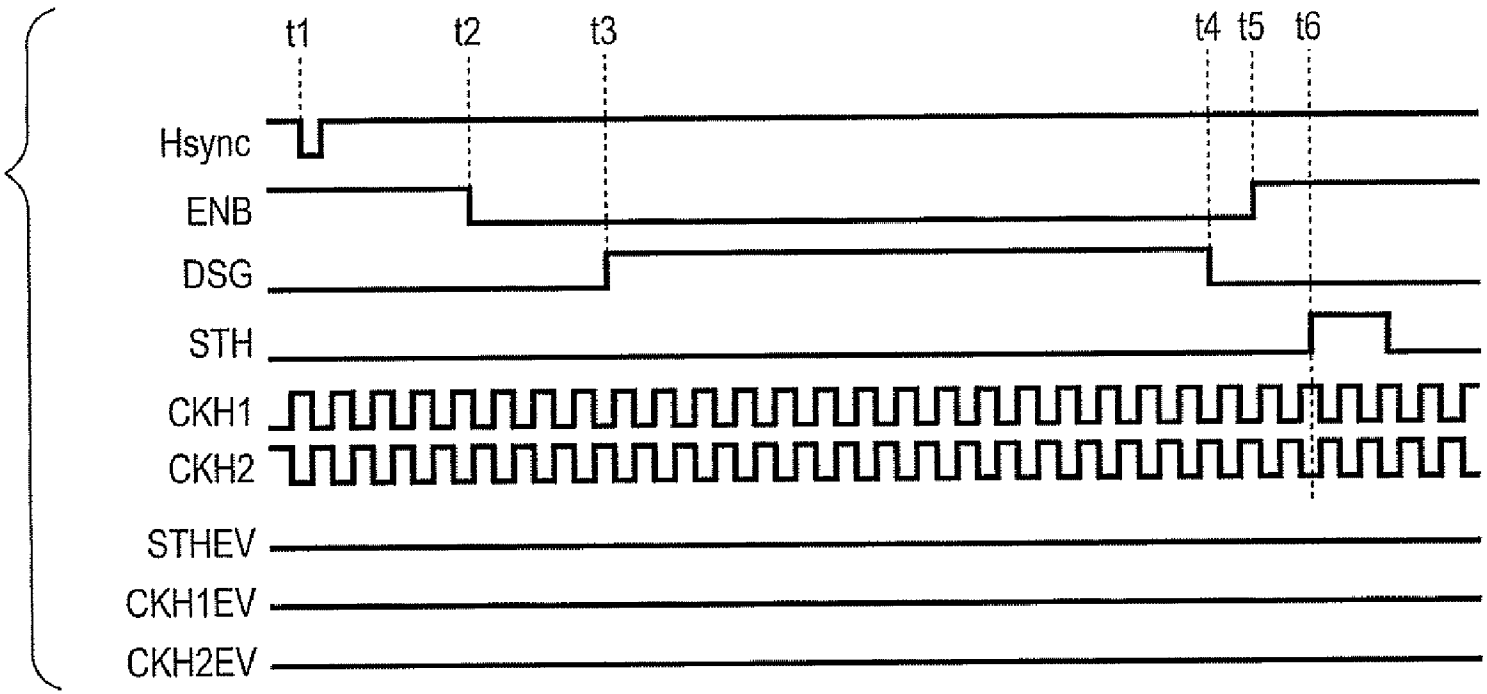
FIG. 7 is a timing chart at the time of precharge drive according to the first embodiment.

Next, an operation of the precharge drive will be described. FIG. 7 is a timing chart illustrating at the time of the precharge drive. Here, a case where the main monitor 30 is set to the display state and the sub-monitor 20 is set to the non-display state will be described. At time t1, for example, when a horizontal synchronization signal Hsync instructing start timing of an n-th one horizontal scanning period is input, the enable signal ENB is turned off at time t2, and thus the vertical scanning circuits 23 and 33 are stopped.

Subsequently, when the precharge signal DSG is turned on from time t3 to time t4, all the precharge switches 254 and 354 of the precharge circuits 25 and 35 are turned on, respectively. At this time, since the sub-monitor 20 is in the non-display state and thus the precharge voltage DSD set to the voltage $V_{DSDs}$ is commonly supplied from the control circuit 10 to each of the display panels 20 and 30, the precharge voltage $V_{DSDs}$ is supplied from the precharge lines 252 and 352 to each of the drain lines DL.

At time t5, the enable signal ENG is turned on to start the operation of each of the vertical scanning circuits 23 and 33. In this way, all the TFTs 114 connected to the n-th gate line GL of the display panels 20 and 30 are turned on, and thus the precharge voltage $V_{DSDs}$ is written to the pixel capacitors LC and LC', respectively.

Subsequently, at time t6, the image signal Video is supplied from the control circuit 10 to each of the display panels 20 and 30. At this time, in the main monitor 30 set to the display state, the horizontal scanning circuit 34 operates to perform writing to the pixel capacitors LC according to the image signal Video. On the other hand, in the sub-monitor 20 set to the non-display state, the precharge voltage $V_{DSDs}$ is maintained in the pixel capacitors LC', since the start signal STHEV and the clock signals CKH1EV and CKH2EV are stopped and the horizontal scanning circuit 24 does not operate.

Figure 10A:
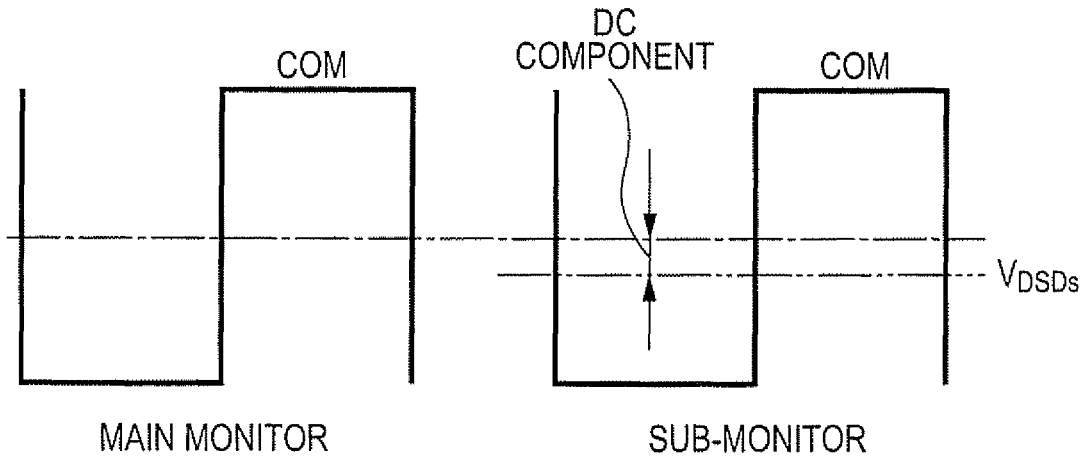
FIGS. 10A and 10B are diagrams illustrating a general precharge voltage.
Figure 10B:
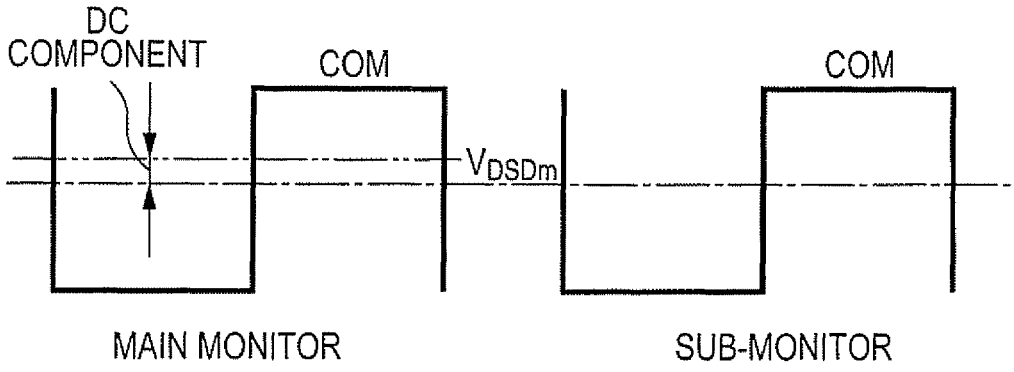

When two display panels are simultaneously driven by one chip IC, a precharge voltage is generally set to a level (the central level of the amplitude of a video voltage of the display panel set to the display state) set in correspondence with the display panel set to the display state, as illustrated by a one-dot chain line in FIGS. 10A and 10B. For that reason, in the pixels of the display panel set to the non-display state, the precharge voltage set to the level is maintained for one vertical scanning period.

In this case, however, when the panel characteristics of the two display panels are different from each other, a DC voltage corresponding to a difference between the central voltage (illustrated by the two-dot chain line) of the amplitude of the video voltage and the precharge voltage (illustrated by the one-dot chain line) in the display panel set to the non-display state is normally applied in the display panel set to the non-display state, thereby causing burn-in.

In the first embodiment, however, the precharge voltage DSD is set to the level corresponding to the display panel set to the non-display state. Specifically, the precharge voltage DSD is set to the central voltage of the amplitude of the video voltage of the display panel set to the non-display state.

Accordingly, when the sub-monitor 20 is set to the non-display state and the main monitor 30 is set to the display state, a relation of the precharge voltage DSD=$V_{DSDs}$ is satisfied. Therefore, in the main monitor 30, pixel writing from the precharge voltage $V_{DSDs}$ corresponding to the panel characteristics of the sub-monitor 20 is performed. In this case, the precharge voltage $V_{DSDs}$ is not the central voltage of the amplitude of the video voltage of the main monitor 30, the precharge voltage $V_{DSDs}$ is different from an original precharge level, but there is no influence on a display.

In the sub-monitor 20, the precharge voltage $V_{DSDs}$ is also maintained during a valid display period. Since the precharge voltage $V_{DSDs}$ is the central voltage of the amplitude of the video voltage in the sub-monitor 20, the DC voltage is not applied to the pixels of the sub-monitor 20. Accordingly, even when the two display panels having the different panel characteristics mutually perform a display, it is possible to prevent the problem with burn-in during the precharge drive of the display panel set to the non-display state.

On the other hand, when the main monitor 30 is set to the non-display state and the sub-monitor 20 is set to the display state, a relation of the precharge voltage DSD $V_{DSDm}$ is satisfied. Therefore, the precharge signal DSG is in the ON state during a period from time t3 to time t4 of FIG. 7, so that the precharge voltage $V_{DSDm}$ is supplied from the precharge lines 252 and 352 to the drain lines DL, respectively.

At time corresponding to time t6, the image signal Video is supplied from the control circuit 10 to each of the display panels 20 and 30, the horizontal scanning circuit 24 operates in the sub-monitor 20 set to the display state and thus writing to the pixel capacitors LC' according to the image signal Video is performed. In addition, since the horizontal scanning circuit 34 does not operate in the main monitor 30 set to the non-display state, the precharge voltage $V_{DSDm}$ is maintained in the pixel capacitors LC.

In the above-described embodiment, the precharge voltage is supplied before an image signal is supplied to the data lines (the invalid display period). Therefore, even when the writing polarity is different in each frame, sufficient pixel writing can be performed. Accordingly, it is possible to improve a display quality of the display panel set to the display state.

In the pixels of the display panel set to the non-display state, the precharge voltage written during the invalid display period is maintained during one horizontal scanning period. At this time, the voltage corresponding to the panel characteristics of the display panel set to the non-display state is supplied as the precharge voltage. Therefore, even when the writing polarity is reversed in each frame, a voltage different in each frame can be prevented from being written to the pixels of the display panel set to the non-display state. In consequence, since the DC voltage is not normally allowed to be applied, the burn-in can be prevented from occurring in the display panel set to the non-display state.

Accordingly, even when the panel characteristics of the plurality of display panels are different from each other, the display panels can be simultaneously driven (mutually displayed) without causing a problem.

Moreover, since the precharge voltage is set to the central voltage of the amplitude of the image data voltage in the display panel set to the non-display state, the burn-in in the display panel set to the non-display state can be more effectively prevented.

Since the switches individually connected to the precharge line and the data lines are controlled during the invalid display period of one horizontal scanning period to electrically connect the precharge line to the data lines and the data lines are controlled with the precharge voltage, a precharge circuit can be realized with a relatively simple circuit configuration.

Power consumption can be suppressed by stopping the driving circuit (the horizontal scanning circuit) and writing the precharge voltage maintained in the data lines to the pixels in the display panel set to the non-display state among the plurality of display panels. In addition, the precharge voltage maintained in the data lines can be easily written to the pixels of the display panel set to the non-display state.

Since the pixels of the display panel set to the non-display state among the plurality of display panels maintain the precharge voltage during about one vertical scanning period, the voltage applied to the liquid crystal can be appropriately set in the non-display state. Accordingly, the burn-in in the display panel set to the non-display state can be more effectively prevented.

In the above-described embodiment, when the main monitor 30 is set to the display state and the sub-monitor 20 is set to the non-display state, as shown in FIG. 7, time t5 at which the operation of the vertical scanning circuits 23 and 33 starts may follow time t6 at which the horizontal scanning circuit 34 operates in the main monitor 30 set to the display state. The same is applied to a case where the main monitor 30 is set to the non-display state and the sub-monitor 20 is set to the display state.

In the above-described embodiment, the precharge signal DSG is set to the common driving signal, but individual signals may be set to individual monitors. In this case, the precharge voltage may be supplied to the data lines of the display panel set to the display state during the invalid display period of one horizontal scanning period. In addition, the precharge voltage may be supplied to the data lines of the display panel set to the non-display state during one horizontal scanning period.

For example, when the main monitor 30 is set to the display state and the sub-monitor 20 is set to the non-display state, all the precharge switches 254 of the precharge circuit 25 are simultaneously turned on in the sub-monitor 20 by turning on the precharge signal DSG after time t3, and the precharge voltage $V_{DSDs}$ is supplied from the precharge line 252 to the drain lines DL during one horizontal scanning period. Subsequently, at time t5, the enable signal ENS is turned on to start the operation of the vertical scanning circuit 23 and all the TFTs 114 connected to the n-th gate line GL of the sub-monitor 20 are turned on to write the precharge voltage $V_{DSDs}$ to the pixel capacitors LC'. In this way, since the precharge voltage can be written to the pixels through the data lines without deterioration in the precharge voltage, the burn-in in the display panel set to the non-display state can be more effectively prevented. The same is applied to the case where the main monitor 30 is set to the non-display state and the sub-monitor 20 is set to the display state.

In the above-described embodiment, the precharge voltage is set to the central voltage of the amplitude of the video voltage of the display panel set to the non-display state, but may be set so as to have a voltage value with which the DC voltage is not applied to the pixels of the display panel set to the non-display state.

In the above-described embodiment, the display device having the two liquid crystal display panels having the different panel characteristics has been described. However, the invention may be applied to a display device having three or more liquid crystal display panels having different panel characteristics. In this case, the timing controller 11 is configured to generate the horizontal start signals and the horizontal clock signals in correspondence with the number of the liquid crystal display panels.

In the above-described embodiment, the display device using liquid crystal has been described, but the invention may be applied to a display device using an electro-optic material other than the liquid crystal.

Next, a second embodiment of the invention will be described. The configuration of the display device according to the second embodiment is the same the configuration of the display device 1 according to the first embodiment shown in FIG. 1. A circuit diagram illustrating the configuration of the sub-monitor 20 is the same as that of FIG. 2 and a circuit diagram illustrating the configuration of the main monitor 30 is the same as that of FIG. 3.

In the second embodiment, as a method of driving the sub-monitor 20, a longitudinal electric field driving method (a TN mode or the like) is used. In addition, as a method of driving the main monitor 30, a transverse electric field driving method (an FFS method, an IPS mode, or the like) is used. Here, the longitudinal electric field driving method refers to a method of driving liquid crystal molecules by an electric field (a longitudinal electric field) generated between pixel electrodes 116 formed on one glass substrate and a common electrode 118 on the other glass substrate. On the other hand, the transverse electric field driving method refers to a method of driving liquid crystal molecules by an electric field (a transverse electric field) generated in an in-plane direction with respect to a glass substrate, when the pixel electrodes 116 and the common electrode 118 are formed in the same substrate.

In the second embodiment, a voltage corresponding to the characteristics of the display panel (the main monitor 30) employing the transverse electric field driving method is set as the precharge voltage DSD.

When one of the two display panels 20 and 30 is set to the display state, the other thereof is set to the non-display state.

Figure 8A:
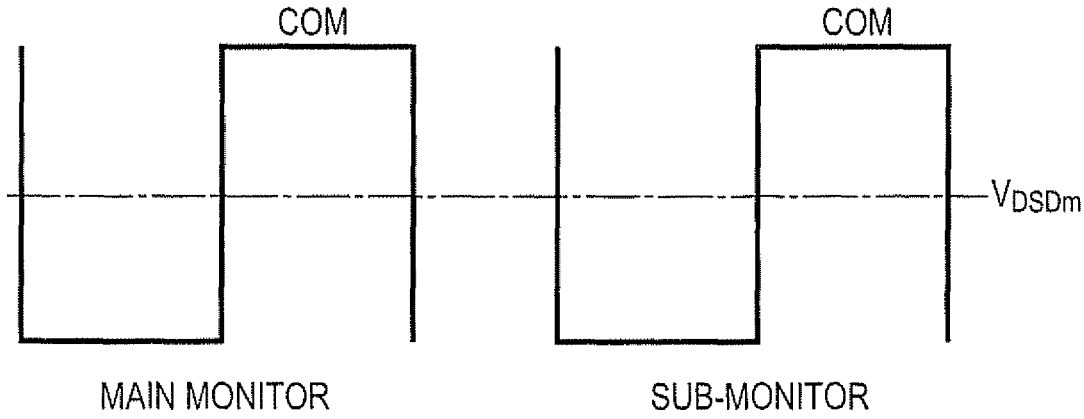
FIGS. 8A and 8B are diagrams illustrating a precharge voltage in each display state according to a second embodiment.
Figure 8B:
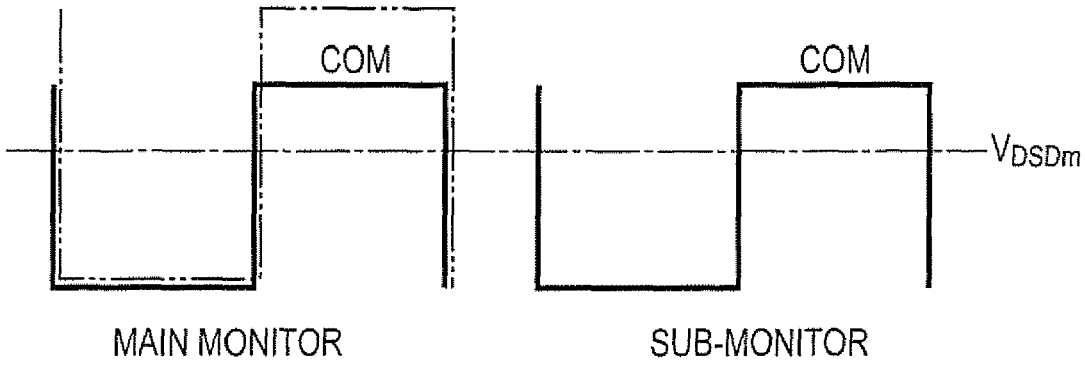

FIGS. 8A and 8B are diagrams illustrating a precharge voltage DSD in each display state. FIG. 8A shows the precharge voltage DSD when the main monitor 30 is in the display state. FIG. 8B shows the precharge voltage DSD when the sub-monitor 20 is in the display state.

Even when one of the sub-monitor 20 and the main monitor 30 is in the display state, as shown in FIGS. 8A and 8B, the central voltage $V_{DSDm}$ of the amplitude of the video voltage in the main monitor 30 is set as the precharge voltage DSD.

The control circuit 10 applies, as an initialization sequence, an OFF voltage to all the pixels of each display panel during a plurality of frame periods (for example, two frame periods), when the power of each display panel is turned ON/OFF or when display switch from the sub-monitor 20 to the main monitor 30 or display switch from the main monitor 30 to the sub-monitor 20 is performed. The OFF voltage means a state where a voltage is not applied to liquid crystal in case of a liquid crystal display panel. For example, a voltage of 0 V is applied to the pixels.

A flowchart illustrating a driving sequence at the time of power ON is almost the same as that of FIG. 5 according to the first embodiment. However, in Steps S4 and S6, the display panel is set to the display state, but the precharge voltage DSD is set to the voltage corresponding to the characteristic of the display panel employing the transverse electric field.

Next, an operation of the precharge drive will be described according to the second embodiment.

Figure 9:
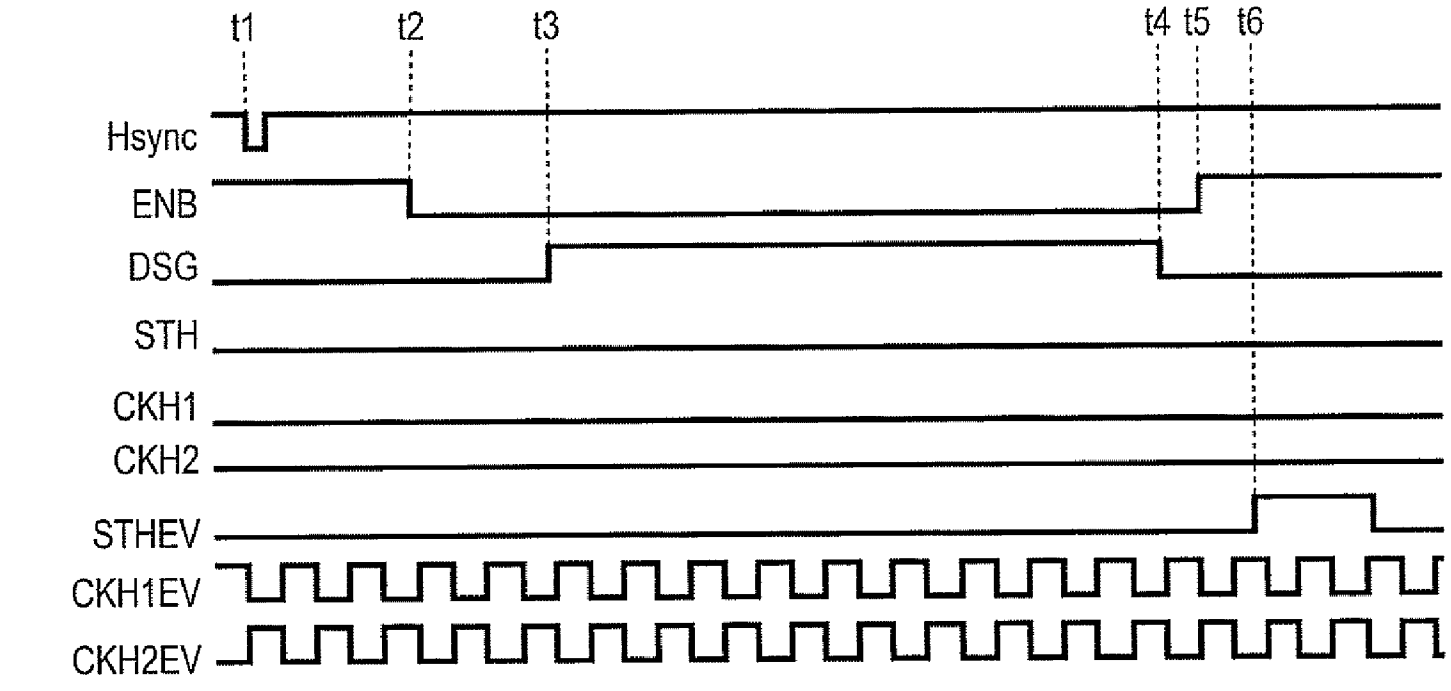
FIG. 9 is a timing chart at the time of precharge drive according to the second embodiment.

FIG. 9 is a timing chart at the time of precharge drive according to the second embodiment. Here, the main monitor 30 is set to the non-display state and the sub-monitor 20 is set to the display state.

At time t1, for example, when a horizontal synchronization signal Hsync instructing start timing of an n-th one horizontal scanning period is input, the enable signal ENB is turned off at time t2, and thus the vertical scanning circuits 23 and 33 are stopped.

Subsequently, when the precharge signal DSG is turned on from time t3 to time t4, all the precharge switches 254 and 354 of the precharge circuits 25 and 35 are turned on, respectively. At this time, since the precharge voltage DSD set to the voltage $V_{DSDs}$ is commonly supplied from the control circuit 10 to each of the display panels 20 and 30, the precharge voltage $V_{DSDm}$ is supplied from the precharge lines 252 and 352 to each of the drain lines DL.

At time t5, the enable signal ENG is turned on to start the operation of each of the vertical scanning circuits 23 and 33. In this way, all the TFTs 114 connected to the n-th gate line GL of the display panels 20 and 30 are turned on, and thus the precharge voltage $V_{DSDm}$ is written to the pixel capacitors LC and LC', respectively.

Subsequently, at time t6, the image signal Video is supplied from the control circuit 10 to each of the display panels 20 and 30. At this time, in the sub-monitor 20 set to the display state, the horizontal scanning circuit 24 operates to perform writing to the pixel capacitors LC' according to the image signal Video. On the other hand, in the main monitor 30 set to the non-display state, the precharge voltage $V_{DSDm}$ is maintained in the pixel capacitors LC, since the start signal STH and the clock signals CKH1 and CKH2 are stopped and the horizontal scanning circuit 34 does not operate.

When two display panels are simultaneously driven by one chip IC, a precharge voltage is generally set to a level (the central level of the amplitude of a video voltage of the display panel set to the display state) set in correspondence with the display panel set to the display state, as illustrated by a one-dot chain line in FIGS. 10A and 10B. For that reason, in the pixels of the display panel set to the non-display state, the precharge voltage set to the level is maintained for one vertical scanning period.

In this case, however, when the methods of driving the two display panels are different from each other, a DC voltage corresponding to a difference between the central voltage (illustrated by the two-dot chain line) of the amplitude of the video voltage and the precharge voltage (illustrated by the one-dot chain line) in the display panel (which is the display panel performing the precharge driving) set to the non-display state is normally applied in the display panel set to the non-display state.

Here, as the method of driving the liquid crystal display panel, as described above, there are the longitudinal electric field driving method and the transverse electric field driving method. In particular, the burn-in occurs more easily in the transverse electric field driving method of driving the liquid crystal molecules by the transverse electric field than the longitudinal electric field driving method.

Accordingly, when the display panel set to the non-display state employs the transverse electric field driving method, the DC voltage is normally applied, thereby causing the burn-in in the display panel set to the non-display state.

In this embodiment, however, the precharge voltage is set to the level corresponding to the display panel employing the transverse electric field, specifically to the central voltage $V_{DSDm}$ of the amplitude of the video voltage of the main monitor 30 employing the transverse electric field driving method.

Accordingly, when the sub-monitor 20 is set to the display state and the main monitor 30 is set to the non-display state, pixel writing from the precharge voltage $V_{DSDm}$ corresponding to the main monitor 30 is performed in the sub-monitor 20. In this case, the precharge voltage $V_{DSDm}$ is not the central voltage of the amplitude of the video voltage of the sub-monitor 20, the precharge voltage $V_{DSDm}$ is different from an original precharge level, but there is no influence on a display.

In the main monitor 30, the precharge voltage $V_{DSDm}$ is also maintained during a valid display period. Since the precharge voltage $V_{DSDm}$ is the central voltage of the amplitude of the video voltage in the main monitor 30, the DC voltage is not applied to the pixels to the main monitor 30.

Accordingly, even when the display panel employing the transverse electric field driving method, which sensitively responds to the burn-in, is set to the non-display state in the case where the two display panels having the different panel characteristics, particularly the different driving methods, mutually perform a display, it is possible to prevent the burn-in during the precharge drive.

Moreover, since the precharge voltage DSD is fixed to the precharge voltage $V_{DSDm}$, it is not necessary to switch the precharge voltage in accordance with the display panel in the display state, like general precharge drive as in FIGS. 10A and 10B.

On the other hand, when the sub-monitor 20 is set to the non-display state and the main monitor 30 is set to the display state, the precharge signal DSG is in the ON state during a period from time t3 to time t4 of FIG. 8, so that the precharge voltage $V_{DSDm}$ is supplied from the precharge lines 252 and 352 to the drain lines DL, respectively.

At time corresponding to time t6, the image signal Video is supplied from the control circuit 10 to each of the display panels 20 and 30, the horizontal scanning circuit 34 operates in the main monitor 30 set to the display state and thus writing to the pixel capacitors LC according to the image signal Video is performed. In addition, since the horizontal scanning circuit 24 does not operate in the sub-monitor 20 set to the non-display state, the precharge voltage $V_{DSDm}$ is maintained in the pixel capacitors LC'.

At this time, in the main monitor 30, pixel writing from the precharge voltage $V_{DSDm}$ is performed. Since the precharge voltage $V_{DSDm}$ is the central voltage of the amplitude of the video voltage of the main monitor 30, sufficient pixel writing from the original precharge level can be performed. Therefore, it is possible to improve a display quality.

In the sub-monitor 20, the precharge voltage $V_{DSDm}$ is maintained even during the valid display period. Since the precharge voltage $V_{DSDm}$ is not the central voltage of the amplitude of the video voltage of the sub-monitor 20, the DC voltage is applied to the pixels of the sub-monitor 20. However, since the sub-monitor 20 employing the longitudinal electric field driving method is not a device reacted sensitively to the burn-in, the sub-monitor 20 does not receive an influence of the turn-in.

In the above-described embodiment, the precharge voltage is supplied before an image signal is supplied to the data lines (the invalid display period). Therefore, even when the writing polarity is different in each frame, sufficient pixel writing can be performed. Accordingly, it is possible to improve a display quality of the display panel set to the display state.

In the pixels of the display panel set to the non-display state, the precharge voltage written during the invalid display period is maintained during about one vertical scanning period. At this time, the voltage corresponding to the display panel employing the transverse electric field driving method is supplied as the precharge voltage. Therefore, even when the writing polarity is reversed in each frame in the state where the display panel employing the transverse electric field driving method is set to the non-display state, a voltage different in each frame can be prevented from being written to the pixels of the display panel employing the transverse electric field driving method. In consequence, since the DC voltage is not normally allowed to be applied, the burn-in can be prevented from occurring in the display panel employing the transverse electric field driving method.

Accordingly, when the driving methods of the plurality of display panels are different from each other, the display panels can be simultaneously driven (mutually displayed) without causing a problem by setting the precharge voltage corresponding to the display panel in which the burn-in easily occurs.

Moreover, since the precharge voltage is set to the central voltage of the amplitude of the image data voltage in the display panel employing the transverse electric field driving method, the burn-in in the display panel can be more effectively prevented.

Since the switches individually connected to the precharge line and the data lines are controlled during the invalid display period of one horizontal scanning period to electrically connect the precharge line to the data lines and the data lines are controlled with the precharge voltage, a precharge circuit can be realized with a relatively simple circuit configuration.

Power consumption can be suppressed by stopping the driving circuit (the horizontal scanning circuit) and writing the precharge voltage maintained in the data lines to the pixels in the display panel set to the non-display state among the plurality of display panels. In addition, the precharge voltage maintained in the data lines can be easily written to the pixels of the display panel set to the non-display state.

Since the pixels of the display panel set to the non-display state among the plurality of display panels maintain the precharge voltage during about one vertical scanning period, the voltage applied to the liquid crystal can be appropriately set in the non-display state. Accordingly, the burn-in in the display panel set to the non-display state can be more effectively prevented.

In the above-described embodiment, when the main monitor 30 is set to the display state and the sub-monitor 20 is set to the non-display state, as shown in FIG. 9, time t5 at which the operation of the vertical scanning circuits 23 and 33 starts may follow time t6 at which the horizontal scanning circuit 34 operates in the main monitor 30 set to the display state. The same is applied to a case where the main monitor 30 is set to the non-display state and the sub-monitor 20 is set to the display state.

In the above-described embodiment, the precharge signal DSG is set to the common driving signal, but individual signals may be set to individual monitors. In this case, the precharge voltage may be supplied to the data lines of the display panel set to the display state during the invalid display period of one horizontal scanning period. In addition, the precharge voltage may be supplied to the data lines of the display panel set to the non-display state during one horizontal scanning period.

For example, when the main monitor 30 is set to the non-display state and the sub-monitor 20 is set to the display state, all the precharge switches 354 of the precharge circuit 35 are simultaneously turned on in the main monitor 30 by turning on the precharge signal DSG after time t3, and the precharge voltage $V_{DSDm}$ is supplied from the precharge line 352 to the drain lines DL during one horizontal scanning period. Subsequently, at time t5, the enable signal ENB is turned on to start the operation of the vertical scanning circuit 33 and all the TFTs 114 connected to the n-th gate line GL of the main monitor 30 are turned on to write the precharge voltage $V_{DSDm}$ to the pixel capacitors LC. In this way, since the precharge voltage can be written to the pixels through the data lines without deterioration in the precharge voltage, the burn-in in the display panel set to the non-display state can be more effectively prevented. The same is applied to the case where the main monitor 30 is set to the display state and the sub-monitor 20 is set to the non-display state.

The plurality of display panels each include a backlight unit and can surely allow the display panel set to the non-display state by turning on the backlight unit of the display panel set to the non-display state. Accordingly, the burn-in in the display panel can be prevented, while suppressing power consumption.

In the above-described embodiment, the precharge voltage is set to the central voltage of the amplitude of the video voltage of the main monitor 30, but may be set so as to have a voltage value with which the DC voltage is not applied to the pixels of the main monitor 30 during the precharge drive.

In the above-described embodiment, the display device having the two liquid crystal display panels having the different driving methods has been described. However, the invention may be applied to a display device having three or more liquid crystal display panels having different panel characteristics. In this case, the timing controller 11 is configured to generate the horizontal start signals and the horizontal clock signals in correspondence with the number of the liquid crystal display panels.

The entire disclosure of Japanese Patent Application Nos: 2008-147802, filed June 5 and 2008-147803, filed June 5 are expressly incorporated by reference herein.

What is claimed is:

1. A display device comprising:

a plurality of display panels which each have a plurality of pixels provided in correspondence with intersections of a plurality of scanning lines and a plurality of data lines and a driving circuit supplying image data to the data lines; and a control circuit which controls the driving circuits of the plurality of display panels, wherein panel characteristics of the plurality of display panels are different from each other and one of the plurality of display panels is set to a non-display state, wherein the display panel set to the non-display state employs a transverse electric field driving method of driving the liquid crystal molecules by a transverse electric field, wherein the control circuit includes a precharge circuit supplying a common precharge voltage to the data lines of each of the display panels, and wherein the precharge voltage is set so as to have a voltage value corresponding to the panel characteristic of the display panel set to the non-display state and employing the transverse electric field driving method, wherein the precharge voltage is set to a central voltage of an amplitude of an image data voltage in the display panel set to the non-display state.

2. The display device according to claim 1, wherein the precharge circuit includes switches which are each connected to a precharge line feeding the precharge voltage and the data lines and which electrically connect the precharge line to the data lines at predetermined timing, and wherein the data lines are controlled by use of the precharge voltage by controlling the switches to electrically connect the precharge line to the data lines.

3. The display device according to claim 1, wherein the display panel set to the non-display state among the plurality of display panels stops the driving circuit and the precharge circuit supplies the precharge voltage to the data lines of the display panel set to the non-display state among the plurality of display panels during about one horizontal scanning period.

4. The display device according to claim 1, wherein the display panel set to the non-display state among the plurality of display panels writes the precharge voltage to the pixels at time in which the display panel set to the display state operates.

5. The display device according to claim 1, wherein the precharge circuit supplies the common precharge voltage to the data lines of each of the display panels during an invalid display period of one horizontal scanning period.

6. The display device according to claim 5, wherein the display panel set to the non-display state among the plurality of display panels stops the driving circuit and writes the precharge voltage maintained in the data lines to the pixels.

7. The display device according to claim 6, wherein the pixels of the display panel set to the non-display state among the plurality of display panels maintain the precharge voltage during about one vertical scanning period.

8. A liquid crystal display device comprising:

a plurality of display panels which each have a plurality of pixels provided in correspondence with intersections of a plurality of scanning lines and a plurality of data lines and a driving circuit supplying image data to the data lines; and a control circuit which controls the driving circuits of the plurality of display panels, wherein the plurality of pixels are formed by a pair of substrates, which are opposed to each other with a liquid crystal layer interposed there between, and a common electrode and pixel electrodes which drive liquid crystal molecules of the liquid crystal layer, wherein one of the plurality of display panels employs a transverse electric field driving method of driving the liquid crystal molecules by a transverse electric field, wherein the control circuit includes a precharge circuit supplying a precharge voltage to the data lines of each of the display panels, and wherein the precharge voltage is set to a voltage value corresponding to the display panel employing the transverse electric field driving method, wherein the precharge voltage is set to a central voltage of an amplitude of an image data voltage in the display panel employing the transverse electric field driving method.

9. The liquid crystal display device according to claim 8, wherein the precharge circuit includes switches which are each connected to a precharge line feeding the precharge voltage and the data lines and which electrically connect the precharge line to the data lines at predetermined timing, and wherein the data lines are controlled by use of the precharge voltage by controlling the switches to electrically connect the precharge line to the data lines.

10. The liquid crystal display device according to claim 8, wherein the display panel set to the non-display state among the plurality of display panels stops the driving circuit and the precharge circuit supplies the precharge voltage to the data lines of the display panel set to the non-display state among the plurality of display panels during about one horizontal scanning period.

11. The liquid crystal display device according to claim 8, wherein the display panel set to the non-display state among the plurality of display panels writes the precharge voltage to the pixels at time in which, the display panel set to the display state operates.

12. The liquid crystal display device according to claim 8, wherein the plurality of display panels each include a backlight unit and the backlight unit of the display panel set to the non-display state is turned off.

13. The liquid crystal display device according to claim 8, wherein the precharge circuit supplies the common precharge voltage to the data lines of each of the display panels during an invalid display period of one horizontal scanning period.

14. The liquid crystal display device according to claim 13, wherein the display panel set to the non-display state among the plurality of display panels stops the driving circuit and writes the precharge voltage maintained in the data lines to the pixels.

15. The liquid crystal display device according to claim 14, wherein the pixels of the display panel set to the non-display state among the plurality of display panels maintain the precharge voltage during about one vertical scanning period.

* * * * *